US006001030A

United States Patent [19]

Delaney

[11] Patent Number: 6,001,030

[45] Date of Patent: Dec. 14, 1999

[54] GOLF PUTTER HAVING INSERT CONSTRUCTION WITH CONTROLLER COMPRESSION

[76] Inventor: William Delaney, 32 Casa Blanca Ct., Clifton Park, N.Y. 12065

[21] Appl. No.: 09/085,541

[22] Filed: May 27, 1998

[51] Int. Cl.[6] ..... A63B 53/04

[52] U.S. Cl. ..... 473/329; 473/340; 473/342

[58] Field of Search ..... 473/324, 329, 473/332, 342, 340, 341

[56] References Cited

U.S. PATENT DOCUMENTS 1,562,956 11/1925 Guerne .
3,211,455 10/1965 Hyden .
3,975,023 8/1976 Inamori .
4,156,526 5/1979 Huggins .
4,569,524 2/1986 Quijano .
5,083,778 1/1992 Douglass .
5,299,807 4/1994 Hutin .
5,332,214 7/1994 Tucker .
5,431,396 7/1995 Shieh .
5,458,332 10/1995 Fisher .
5,766,093 6/1998 Rohrer .

*Primary Examiner*—Sebastiano Passaniti
*Attorney, Agent, or Firm*—Paul J. Cook

[57] ABSTRACT

This invention relates to a golf club head capable of controlling compression of a face plate during ball striking at various club head speeds. Club head designs further result in an increased sweet spot for more consistent ball contact during off center mishits.

11 Claims, 8 Drawing Sheets

GOLF PUTTER HAVING INSERT CONSTRUCTION WITH CONTROLLER COMPRESSION

BACKGROUND OF THE INVENTION

1. Field of the invention

This invention relates to a golf putter club head construction and more particularly to a golf putter club head construction including a cushioned layer which controls compression. More particularly, this invention relates to a golf putter club head which includes an exposed rigid face plate and at least one flexible layer interposed between the club head and rigid face plate.

2. Description of the Prior Art

The sport of golf is played with irons, woods and a putter.

Irons and woods have the ball on the club head surface for a longer period of time than a putter. The increased contact time between the ball and the club head maximizes ball spin in the air. A putter absorbs energy and slowly releases the energy when in contact with a ball so that the ball is not quickly accelerated from the club with backspin as easily as with irons or woods. This characteristic results in a truer roll of the ball on the putting green. In addition, some putter head designs increase the sweet spot of a club head to reduce vibration after contact with the ball thereby to improve distance on off-center hits. This reduction in vibration improves the "feel" of the club at impact with the ball. "Feel" is a common term in golf for a golfer having a sensation of being able to control a balls' action Conventionally, club heads are constructed of one solid material or of a composite of metal materials. More recently, club heads are being coated with materials such as ceramics or titanium to provide more deflection of energy to the ball with deceased club head weight. The essential property of a club face plate is to deflect energy to a ball with minimum of energy absorption. If this is accomplished, the result is controlled distance of ball travel. Unfortunately, a quick deflection of energy results in minimum time of a ball on the club face with an accompanying loss of feel. Control of a ball through feel is critical to a golfer's success in controlling distance and direction of golf ball travel.

Control of golf ball travel is most critical with clubs which are used for short yardage distance such as occurs with pitching, chipping and putting clubs. With clubs which perform these functions, the longer period the ball is in contact with the club face, the more control there is of ball spin in the air for chipping and pitching and roll on the ground for putting.

Each club is used to hit a ball with a particular distance range depending on the speed of the club head when it strikes the ball. Present clubs which are designed to cushion a club face at impact to provide some improvement in feel at some distances with little improvement at other distances.

Many materials such as resins, rubbers, fiber glasses, various type of ceramics, nylon, plastics have been described for use in a club head but deteriorate with time from natural breakdown or stress fatigue from constantly hitting a golf ball. Other materials which have minimum breakdown with time offer little elasticity for a true improvement in feel. The use of these materials is never controlled by comparing and controlling elastic layer thickness to elastic layer softness to club head face plate surface area to club head speed ratios. In addition, there is no control of compression at various club head speeds by use of multiple layers of different durometer at controlled thickness.

In U.S. Pat. No. 3,975,023, Inamoari describes a club head capable of increasing the flying distance of the ball hit in a substantial degree, imparting a refreshing feeling of the ball hitting to the player and being manufactured at low cost and durable for long time use. The club head design incorporates an intermediate plastic or rubber layer. However, there is no consideration of ratio of this material softness to thickness to face plate area which would allow compression of material when the club head speed is slow and maximum compression of material when the club head speed is fast. Compression at various speeds is not controlled by structuring an elastic layer which will fully compress and cause compression of a different layer. The patent states that the purpose is to achieve an increase of 30% distance which further implies that only maximum club head speed is being considered. In addition, there is no design consideration of the intermediate layer which could increase the sweet spot and improve performance of off center ball strikes.

In U.S. Pat. No. 4,630,829, Nishigaki describes a club head with a face portion consisting of layers of glass fibers or carbon fibers laminated alternately. The club head is designed to increase the sweet spot and the center of gravity distribution as well as the hardness and roughness of a ball striking surface but does not allow increased compression and feel especially at various club head speeds.

In U.S. Pat. No. 4,793,616, Fernandez describes a club head which is constructed of a molded lightweight composite material. The design is intended to provide improved weight and mass distribution for better ball striking. The patent does not provide a club head with improved compression and feel.

In U.S. Pat. No. 5,403,281, Chen describes a shock absorbing casing of a magnesium alloy and an elastic plate of an aluminum alloy, a titanium alloy or a ceramic material. The elastic plate is fastened securely to an open end of the hollow casing such that the elastic plate forms the ball striking face of the golf club head. The shock absorbing elastic plate of this invention does not provide variable controlled compression and golf feel.

In U.S. Pat. No. 5,340,107 Baker describes a highly polished monolithic putter of silicon nitride and construction technique. The putter provides highly polished aesthetically pleasing head. The putter does not provide an intermediate layer which compresses for better ball spin and roll nor does it provide better feel. The construction technique and material usage is also time consuming and expensive.

Accordingly, it would be desirable to provide a golf putter club head which allows controlled compression of and release of a face plate when contacting a golf ball. Such a construction would permit control of golf ball roll and provide the golfer with a good feel when the club strikes the ball.

SUMMARY OF THE INVENTION

The present invention provides a putter golf club having an exposed rigid face plate made of ceramic, metal, plastic, resin, or the like having a hardness essentially the same or greater than the hardness of a golf ball as required by the United States Golf Association. (U.S.G.A.) A flexible layer which is characterized by a hardness gradient is interposed between the club head and the face plate to allow controlled compression of and release of the face plate when the putter club strikes a golf ball. The flexible layer can comprise two or more elastic layers each having a different hardness or can comprise a single layer having a hardness gradient throughout its thickness. A first portion of the flexible layer reaches maximum compression at a fixed club head speed prior to the remaining portion of the flexible layer reaching a maximum compression. The exposed rigid face plate is free to move when the flexible layer is compressed and when the flexible layer expands after being compressed.

The present invention provides increased contact time the ball is on the club face plate during a putting stroke with minimum loss of energy in that the club face compression is quick and, upon release of the ball from the club face plate fully rebounds to its original position. Therefore, the club head structure of the invention provides maximum feel for the golfer with minimum loss of distance. In addition, the putter club provides true roll on the ground when putting.

Accordingly, a primary objective of this invention is to provide a putter club head with a face plate structure which compresses when striking a ball and which releases maximum energy back into the ball regardless of the putter club head speed. The ball has a true roll when the ball stays on the ground as occurs with putting. Another objective of this invention is to provide a club head which is durable and long lasting.

The club head structure of this invention provides reduced club head vibration but does not act as a spring to provide additional acceleration to the ball. Means for providing such a spring force is not allowed under present United States Golf Association rules.

In addition, a primary objective of this invention is to provide an increased area of sweet spot on the club face so that the area on the club face which contacts the ball without effecting a significant decrease in ball travel distance is correspondingly increased. This increased sweet spot area reduces poor putts of the player.

DESCRIPTION OF SPECIFIC EMBODIMENTS

Figure 1:
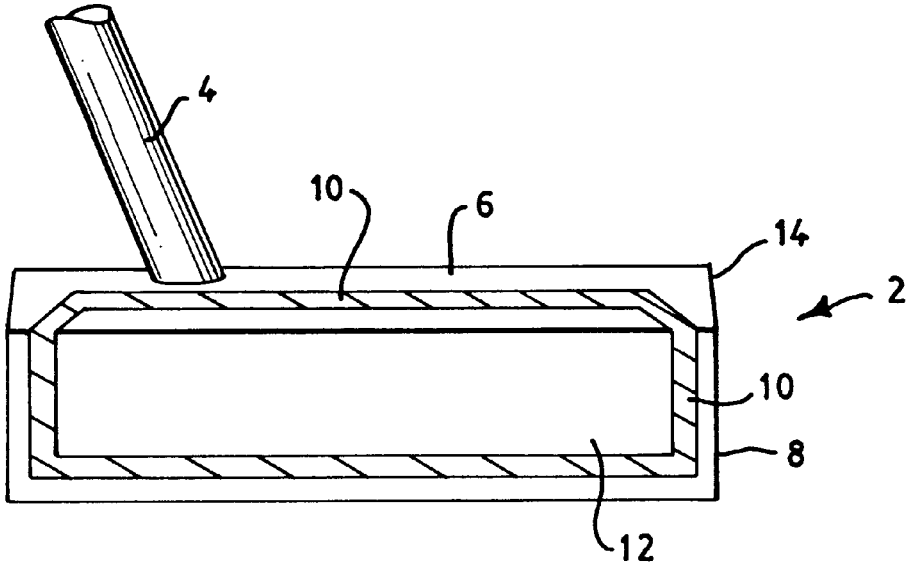
FIG. 1 is a front view of a putter head, face plate and elastic layer of this invention in which the elastic layer extends onto the face and the top surface of the putter.

The putter club head structure of this invention consists of three major components, a club head, an exposed relatively rigid face plate which is attached to a flexible layer and the flexible layer having a hardness gradient through its thickness positioned between the club head and the face plate. The face plate is free to move in response to contraction or expansion of the flexible layer. The club head and the club head face plate are constructed of any material commonly used in club head construction such as metals including gold, magnesium, stainless steel, titanium, beryllium, bronze, aluminum, balata, or the like which is sufficiently hard enough to meet USGA standards. The face plate has a Shore Hardness as measured on the Shore A Durometer scale of at least the hardness of a golf ball and at least 90, preferably at least about 100. The surface of the face plate is rough in one version to provide a response similar to present clubs. In one alternative, the face plate surface is highly polished and smooth to impart little to no frictional effect on the ball.

The flexible layer includes at least one portion which is more easily compressed than the remaining portion of the flexible layer. Thus, this at least one portion can be made of a softer material than the remaining portion and/or it can comprise less material for a given thickness than the remaining portion for either configuration. One portion of the flexible layer requires less force to attain its maximum compression as compared to the force on the remaining portion to attain its maximum compression. For convenience, unless specifically described otherwise, this invention will be described with reference to a softest or softer layer and a layer harder than the softest or softer layer. This flexible layer construction is provided so that its softest portion reaches a state of maximum compression prior to the remaining flexible portion. The flexible layer can be formed of two or more separate layers or of a single layer having a hardness gradient configuration. The softest layer or softer portion of the single layer having a hardness gradient configuration has a Shore Hardness as measured on the Shore A Durometer scale between about 4 and about 75, preferably between about 10 and about 40.

The flexible layer can be formed of two or more continuous layers such as strips having a thickness between about 0.01 inch and about 0.5 inch, preferably between about 0.03 inch and about 0.10 inch. Typically, these continuous layers have a width between about 0.5 inch and about 2.5 inch, preferably between about 0.5 inch and about 1 inch and a length between about 0.5 inch and about 9 inch, preferably between about 2 inch and about 5 inch. The flexible layer also can be formed of discrete pieces having a varying cross section which can be maintained as separated discrete pieces or which can be positioned in a layer of a very soft flexible material having a Shore Hardness as measured on the Shore A Durometer scale of less than about 40, preferably less than about 15. Thus a typical very soft flexible material for this purpose is silicone rubber. Examples of varying cross sections for these discrete pieces include triangles, trapezoids, circles, ellipses or the like. These varying cross sections require a force gradient force on the outer plate in order to attain maximum compression of a given thickness of a discrete piece. Smaller cross sectional areas of each piece require only a smaller force to effect maximum compression. The thickness of a discrete piece having the largest cross sectional area requires the greatest force of the of the forces exerted on the outer plate in order to effect maximum compression.

Exemplary suitable materials for forming the flexible layer includes silicone rubber or soft plastic resin such as acrylic polymers, methacrylic polymers, acrylate polymers, butyl rubbers, polyethers, foam rubber, balata or the like.

It is desired to have the ratio of absorbed energy to imparted energy relatively constant at any club head speed. This result is accomplished with materials which are very hard. However, feel and control of ball roll is lost with hard materials used alone. With soft materials used alone, such as rubber, it is difficult to attain a constant ratio of absorbed energy to imparted energy at various club head speeds. The invention provides a putter construction which solves these problems.

In use, the putter of this invention strikes a ball and imparts energy to the ball to cause a forward ball motion. The amount of energy imparted to a ball is a function of the speed of the club and a ratio of the amount of energy absorbed by the putter club head face to the amount of energy to a ball.

A flexible first layer having a low durometer (soft) compresses at low club head speed but as club head speed increases, maximum compression of the first flexible layer is reached and force is applied to a second harder flexible layer. Compression of the second layer of higher durometer only occurs at higher club head speed. For example, with short putts of inches to a few feet, the face plate is moved into the club head upon impact with a ball when the softer flexible layer compresses. The compressed flexible layers push the face plate and then expand to push the ball forward. The ball accelerates off the face plate at a rate slower that when the elastic layer is not present. The action of the flexible layer and the movement of the face plate provide both a high ratio of absorbed energy to impart energy and good feel and ball control. When longer putts are attempted which are ten to one hundred feet, the elastic layer receives more force and is compressed and expanded to a greater degree. However, the high ratio of absorbed energy to imparted energy and good feel and control are maintained.

In a preferred design, when the exposed face plate is constructed of silicon nitride is about 0.100 inches thick by about 2.5 inches long by about 0.75 inches wide, a silicone elastic layer of durometer 14 on the Shore A scale having a thickness between about 0.01 inch and about 0.09 inch is used as the softer flexible layer. The harder flexible layer having a durometer between about 20 and about 80 on the Shore A scale is used. The harder flexible layer has a thickness between about 0.01 inch and about 0.09 inch. Ideally, the thickness of the elastic layer from the back of the face plate to the next elastic layer of higher durometer in the club head is about 0.05 inches. A short putt of one foot causes compression of the face plate with improved feel and a truer roll of the ball. A long putt, for example fifty feet or more causes more compression of the harder flexible layer than a short putt but the amount of compression must be less than 0.09 inches because it can not compress more than the thickness of the harder flexible layer. The small distance the putter face plate moves backwards allows for a quick full rebound forward. Because the putter head speed is faster for long putts, than for short putts, quick rebound assures enough time for full rebound of the flexible layer and energy is not lost. This results in little to no reduction in the distance a ball travels as compared to utilize in the face plate alone with no flexible layer.

To emphasize the importance of controlling elastic layer durometer, the following example is provided. When utilizing a putter face plate and a silicone layer having a Shore A durometer 1 inch thick, a substantially different result occurs with long paths as compared to short putts. A short putt of 1 foot produces a result similar to the preferred design of this invention in that the ball moves the same distance as with a putter utilizing the face plate without the silicone rubber. A small force causes a similar amount of compression of the face plate. A long putt of about fifty feet causes more compression of a 1 inch silicone layer. The amount of compression requires an increased time to permit the soft silicone rubber to rebound back to its original dimension. Because the putter head speed is quick for long putts, insufficient time is available to permit full rebound of the flexible rubber layer while the ball is in contact with the face plate and energy to be transferred from the expanding silicone rubber layer to the ball is lost. The ball leaves the face plate prior to full rebound and the ball travels a substantially reduced distance as compared to a putter utilizing only the hard face plate without the soft silicone rubber. This particular design is unrealistic for use on large greens or provide adequate mechanical properties for distance control. In contrast, with the putter of this invention, the ratio of energy absorbed by the putter club head to energy imparted to the ball is relatively constant at all club head speeds.

The amount of energy imparted to a ball is also a function of where on the club face a ball is struck. The center area of a club face provides the most energy transfer and is referred to as a sweet spot. It is desirable to have the sweet spot as large as possible so hits which are off the center area have minimum effect on the desired distance. The sweet spot improved with the putter of this invention is a substantially reduced distance as compared to a putter utilizing only the hard face plate without the soft silicone rubber. When a ball strikes a face plate toward the toe of a putter positioned away from the golfer, compression of the toe end of the face plate occurs. A fulcrum between the point of compression and the heel of the putter opposite the point of compression and beyond the fulcrum line undesirably lifts the face plate away from the elastic layer and the club head.

In an alternative embodiment, adhesive is used to join the club head to the flexible layer and the flexible layer to the face plate. When a ball strikes the face plate toward the toe of a putter, compression of the toe end of the face plate occurs. A fulcrum between the point of compression and the heel of the face plate results. The face plate opposite the point of compression and beyond the fulcrum line does not lift away from the flexible layer and the club head and the flexible layer is stretched. When utilizing an adhesive in this manner, the point of original compression beyond the fulcrum is forced out quicker and restores more energy to the ball.

In another embodiment, the fulcrum effect is further influenced by the design of the elastic layer which surrounds the face plate. The fulcrum created by compression on off center hits by a ball create an arc motion of the face plate. The design of the face plate has as few as two sides exposed on the face and as many as all four sides to include a distal side, a medial side, a top side and a bottom side. Therefore, compression of material which surround the face plate is effected. Design features such as internal beveling of the club head cavity and reverse beveling of the face plate create improved compression of lateral flexible material with no sacrifice of compression on the lateral areas of elastic material is improved by use of a soft elastic area behind the face plate with a firmer elastic material used to surround the face plate. A firmer elastic material around the putter face also improves long term wear and durability.

In another alternative, the flexible layer does not completely cover the back of an insert. A higher durometer material is used as an elastic layer because it provides increased force per area with decreased elastic layer area.

Utilizing a hard or high durometer material at the surface of the putter head with no low durometer material at the surface eliminates soft elastic material or an edge of the putter or face plate from accidently striking the ball. Elimination of flexible material at putter head surface by intimate contact of the face plate to the putter head cavity of leaving a space provides similar advantages.

There are many techniques which are used to manufacture different forms of the club of this invention. One technique places the softer flexible layer such as silicone rubber in a putter head cavity and positions a face plate into the softer flexible layer allowing excess silicone rubber to flow out of the club head after applying adhesive to the putter face cavity and the face plate. The face plate is positioned by a form, jig, face plate tabs or the like and excess silicone rubber is removed prior to hardening or trimmed after hardening. In an alternative manufacturing technique, a solid sheet of flexible material such as silicone rubber is added to the back of a face plate which is further adhered to the back wall of a putter cavity. Elastic material such as a higher durometer silicone is injected into the space on the sides of the face plate.

Alternative methods of manufacture consist of preforming each component and assembly from the sides, bottom, top, front or back of a putter head to include a putter head with a removable back section.

With reference to the figures, the phrase "elastic layer" refers to a flexible layer formed from at least two flexible materials having different hardness or to a flexible layer having a varying cross section which results in a hardness gradient or a construction which requires a force gradient through the flexible layer thickness to achieve maximum compression of a given thickness of the flexible layer. through the thickness of the flexible layer. Referring to FIG. 1, putter 2 includes putter head 14 which is attached by conventional methods to shaft 4. Putter head 14 includes face plate 12 which is joined to putter head 14 by elastic layer 10 with mechanical and or adhesive means. The elastic layer 10 is positioned on front portion 8 and top portion 6 of putter head 14. In other alternatives, the exposed elastic layer is confined to only the front surface of the putter head 14 or can include any of the other putter head surfaces. In a preferred design, the areas of elastic layer 10 is recessed not to be coplanar with face plate 12 and front surface 8 of putter head 14. Face plate 12 is formed of a hard durometer material similar to the hardness of a ball. A low durometer material is positioned behind the face plate 12 within putter head 14. In alternative designs, elastic layer 10 is coplanar to face plate 12 and front surface 8 of putter head 14 such that there is no opening between face plate 12 and putter head 14. The dimension of open area ranges from one micron to several millimeters in width. In alternative designs, face plate 12 is forward of front face 8 of putter head 14.

Figure 2:
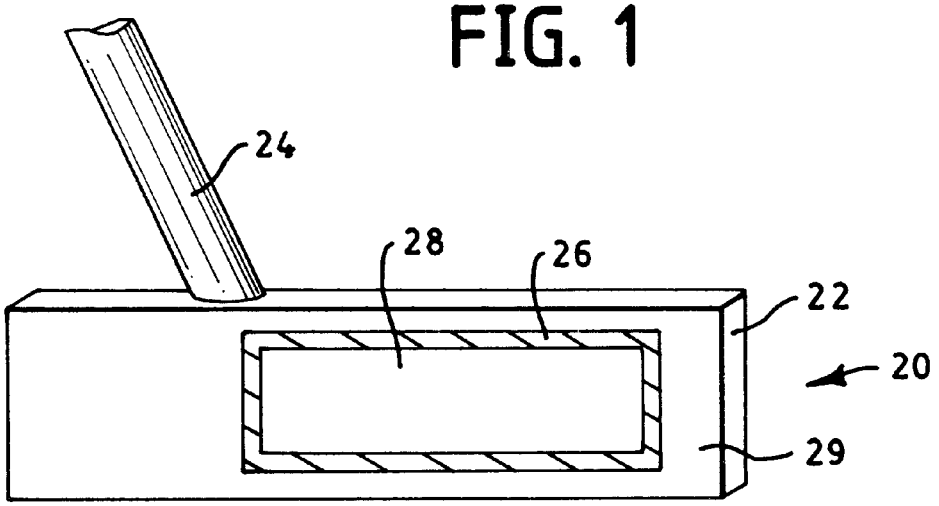
FIG. 2 is a front view of an alternative putter head of this invention in which the elastic layer is confined to the front face surface.

Referring to FIG. 2, an alternative putter 20 of this invention includes shaft 24 attached to putter head 22. Putter head 22 includes face plate 28 surrounded on the back, sides, top and bottom by dual durometer elastic layer 26 which is confined to front surface 29 of putter head 22. Alternatively, the elastic layer 26 is recessed.

Figure 3:
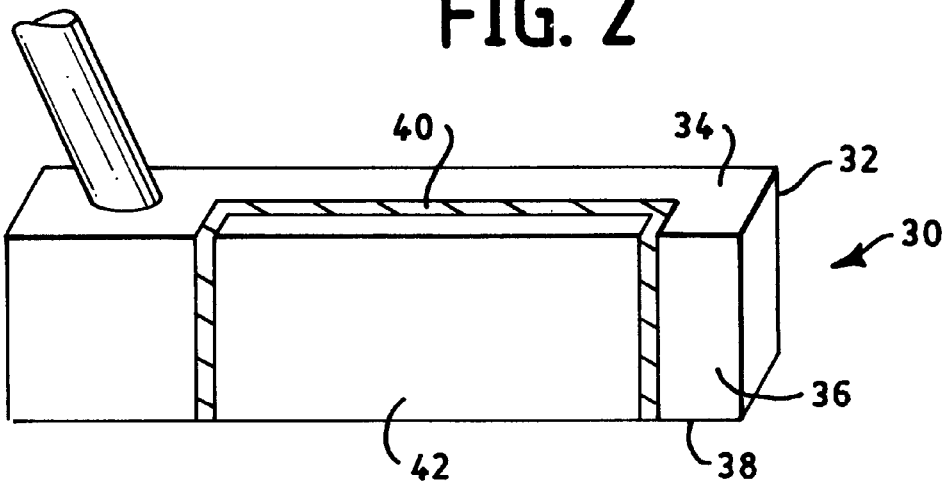
FIG. 3 is a front view of an alternative putter head of this invention in which the elastic layer extends on the face, top and bottom surfaces of the putter.

Referring to FIG. 3, an alternative putter 30 includes putter head 32 having face plate 42 attached by dual durometer elastic layer 40. Elastic layer 40 extends to the back and side surfaces of face plate 42 such that elastic layer 40 is exposed on top surface 34, front surface 36 and bottom surface 38 of putter head 32. Alternatively, the elastic layer 40 is recessed.

Figure 4:
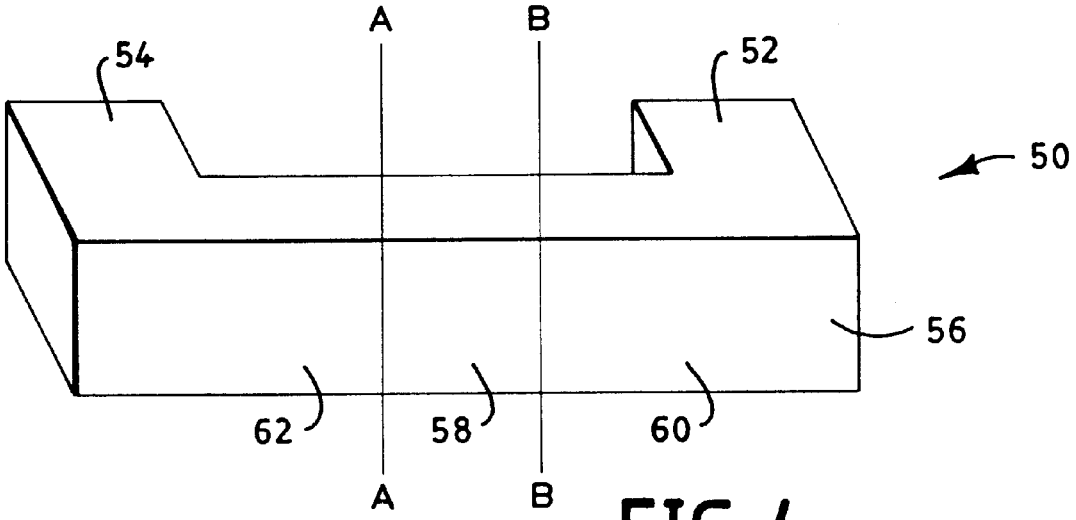
FIG. 4 is a front view of present putter head technology showing a sweet spot.

Referring to FIG. 4, a conventional putter head 50 is shown. The conventional putter head 50 has added weight areas 54 and 52 which are extended to the outer sections of putter head 50. The effect of this weight distribution is to increase the area of maximum striking force referred to in golf as the sweet spot. Line A—A and Line B—B divide the putter front surface 56 in sections 58, 60 and 62. Section 58 is the sweet spot and applies the most force to a ball while sections 56 and 60 apply less force. It is advantageous to increase the width of sweet spot 58 so off center ball strikes minimize lessened distance a ball travels.

Figure 5:
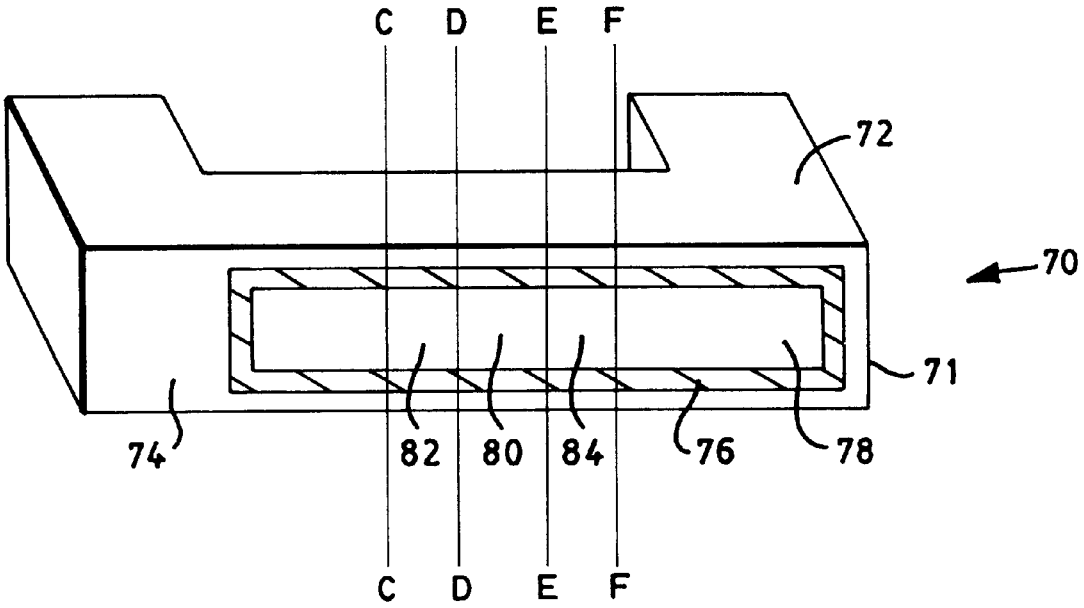
FIG. 5 is a front view of an alternative putter head of this invention showing an increased sweet spot.

Referring to FIG. 5, an alternative putter 70 of this invention is shown. Face plate 78 is joined to putter head 70 by dual durometer elastic layer 76, Face plate 78 is shifted to the side of the putter head 72 such that the center is toward the outside or toe 71. The sweet spot of front surface 74 of putter head 72 without considering face plate 78 is between line C—C and line E—E. The sweet spot of face plate 78 is between line D—D and line F—F. When the two sweet spots are combined, the effective sweet spot is between line C—C and line F—F because area 80 between line D—D and E—E is most effective, however, there is little difference between area 80 and area 82 between line C—C and D—D and area 84 between line E—E and F—F.

Figure 6:
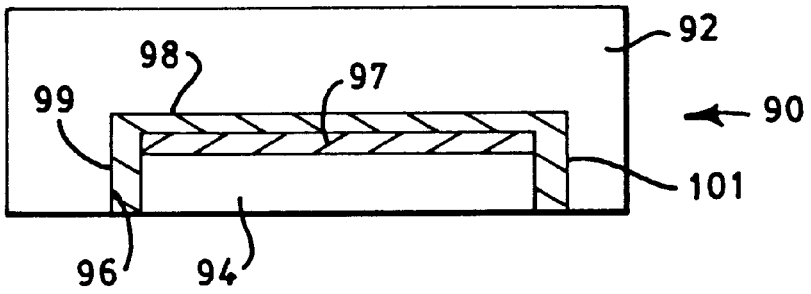
FIG. 6 is a horizontal cross section view of an alternative putter head of this invention.

Referring to FIG. 6, a cross section view of putter head 92 of putter 90 is shown. Face plate 94 is held in position by elastic layer 96 and elastic layer 97 of higher durometer than elastic layer 96 which when compressed is resisted by the walls 101 and 99 of cavity 98 within putter head 92. Alternatively, the elastic layers 96 and 97 are recessed.

Figure 7:
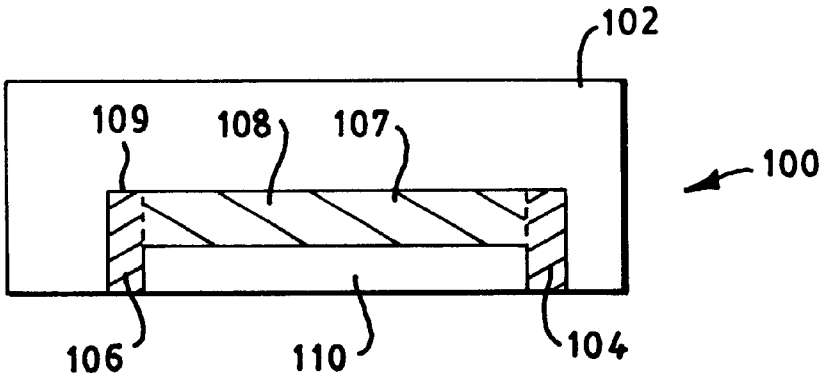
FIG. 7 is a horizontal view of an alternative putter head of this invention in which two different elastic materials are used.

Referring to FIG. 7, a cross section view of an alternative putter of this invention is shown. Putter head 102 of putter 100 has face plate 110 with elastic layer 108 behind it and elastic layer 106 and 104 of higher durometer than elastic layer 108. The elastic layer 106 and 104 is made of a higher durometer than elastic layer 108 to minimize wear and provide improved resistance against any lateral forces. Elastic layers 104 and 106 are extended to the back wall 109 of putter cavity 107 of putter head 102 or can be recessed only part way back and limited to a portion of the thickness of the face plate thickness.

Figure 8:
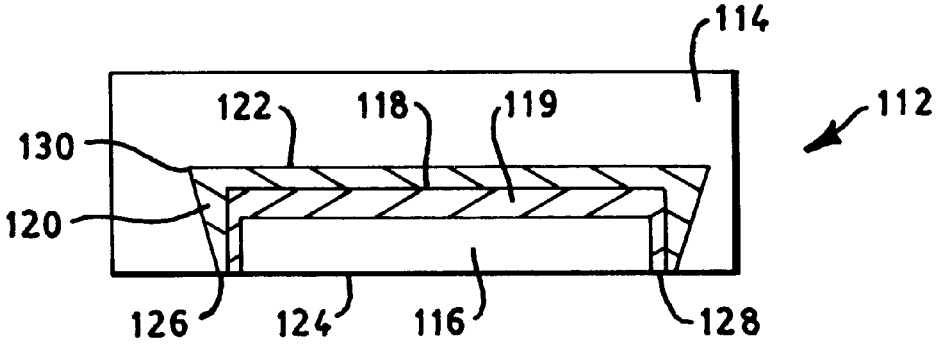
FIG. 8 is a horizontal cross section view of an alternative putter head of this invention with the putter head cavity having angled side walls.

Referring to FIG. 8, a cross section view of an alternative putter of this invention is shown. Putter head 114 of putter 112 includes face plate 116 which is joined by elastic layer 118 and elastic layer 119 of higher durometer than elastic layer 118 into putter head cavity 122. Back wall 130 of putter head cavity 122 is longer than the combined front length of elastic layer surface 126 and 128 combined with front surface 124 of face plate 116. This elastic layer 120 is triangular in shape. Triangular elastic layer 120 provides increased material thickness and retentive strength with minimal material tear or wear. The surface area at elastic layer external surfaces can be one micron to one centimeter wide and can be coplanar with plate 116 or recessed within plate 116.

Figure 9:
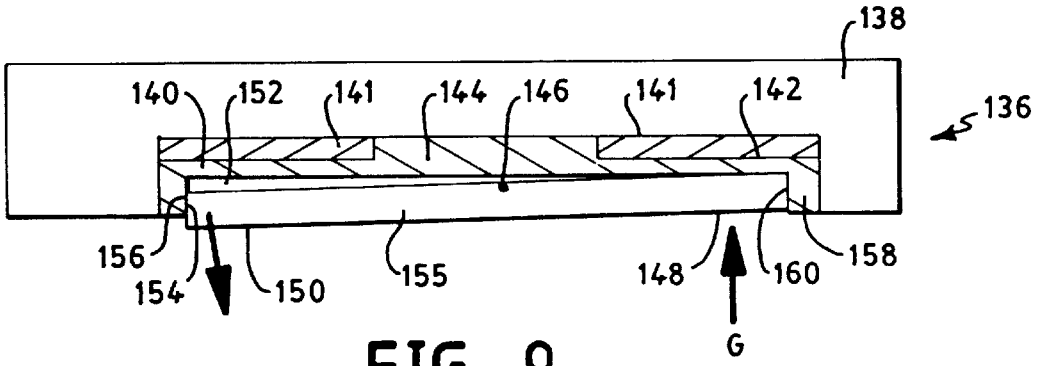
FIG. 9 is a horizontal cross section view of an alternative putter head of this invention showing compression due to off center ball strikes.

Referring to FIG. 9, a cross section view of an alternative putter head 138 of putter 136 is shown under compression of a ball contacting point G. When force is applied at point G, a fulcrum point of rotation is created at fulcrum 146 such that side 148 of face plate 155 compresses into elastic material 142 and elastic layer 141 of higher durometer than elastic material 142. As a result, side 150 of face plate 155 is positioned away from elastic layer 140 leaving space 152. Movement of face plate 155 around fulcrum point 146 is approximately circular or in an arc such that side wall 154 and 160 of face plate 155 compress into elastic layer 156 and 158 respectively. The dimensions and durometers of elastic layers 156 and 158 control amount of rotation around fulcrum point 146 such that increased durometer or decreased thickness decreases rotation.

Figure 10:
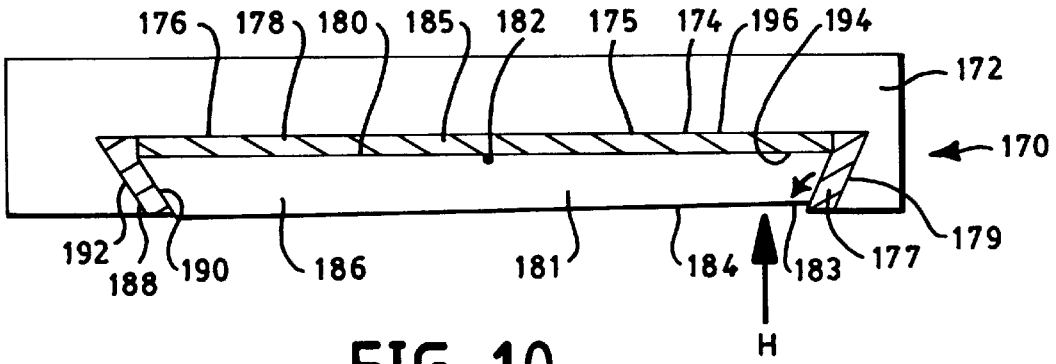
FIG. 10 is a horizontal cross section view of an alternative putter head of this invention showing controlled compression during off center ball strikes.

Referring to FIG. 10, a cross section view of an alternative putter head 172 of putter 170 of this invention is shown under compression of ball contact at point H. The contact force at point H results in end 184 of face plate 181 applying force to elastic material 185 through back surface 194 of face plate 181 against back wall 196 of cavity 175 of putter head 172 resulting in lift of end 186 of face plate 181. The rotation of face plate 181 around fulcrum point 182 results in several actions in different areas. In this embodiment, an adhesive layer covering all interfaces is placed to hold elastic layer 185 to face plate 181 and to putter cavity 175 of putter head 172. Compression of face plate 181 and rotation around fulcrum point 182 results in side wall 183 pulling on elastic layer 177. Elastic layer 157 pulls against side wall 179 of putter head cavity 175 of putter head 172 resulting in stretching of elastic layer 177. Back wall area 180 of face plate 181 stretches elastic layer 178 which applies tensile force on back wall area 176 of putter head cavity 175 of putter head 172 when joined by adhesive or mechanical or chemical means. Side wall 190 of face plate 181 also compresses elastic material 188 against side wall 192 of putter head cavity 175. Elastic areas 177 and 188 are of differing increased or decreased durometers, preferably increased durometer, than back elastic areas 178 and 174 so as to minimize rotation around fulcrum point 182 and compression of side 184 of face plate 181 when ball strike H occurs. This results in an increased sweet spot area on face plate 181. When elastic area 188 and 177 are very hard such as with balata, gold, brass or the like, the fulcrum point is eliminated as rotation occurs around the end of face plate 181.

Figure 11:
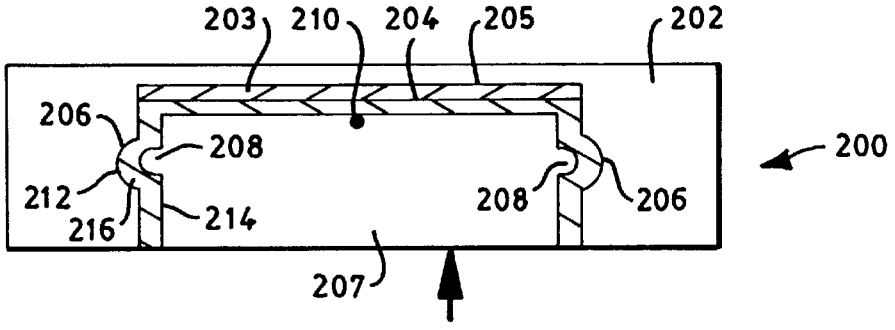
FIG. 11 is a horizontal cross section view of an alternative putter head of this invention.

Referring to FIG. 11, a cross section view of an alternative putter head 202 of putter 200 of this invention is shown. Putter head 202 is joined to face plate 207 by elastic layer 204 and elastic layer 203 of higher durometer than elastic layer 204. Face plate 207 has extensions 208 which are of any shape and extend outward toward indentations 206 in putter head cavity 205 of putter head 202. Ball contact at point I creates a fulcrum at point 210 with resulting rotation of face plate 207. Extension 208 of face plate 207 creates resistance to the rotation such that side 214 of extension 208 compresses elastic material 216 against wall 212 of indentation 206. Resistance to rotation creates a more effective sweet spot and better ball striking with off center ball contact.

Figures 12, 13, 14, 15, 16:
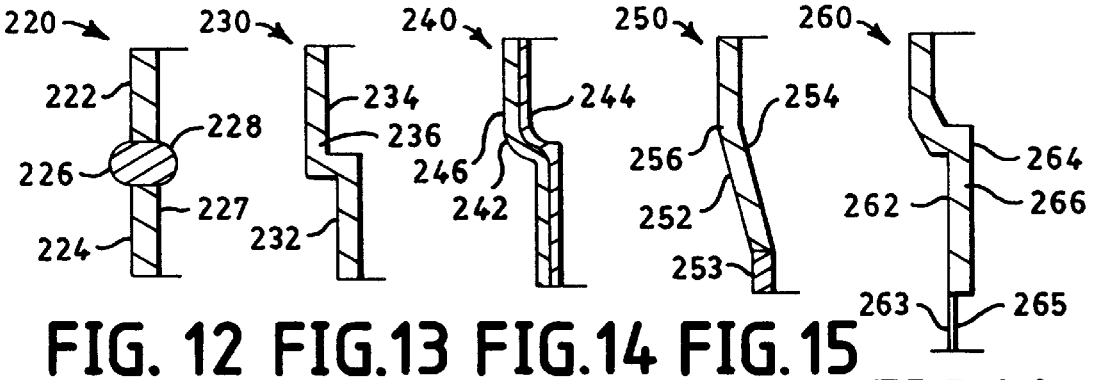
FIG. 12 is a horizontal cross section view of an alternative elastic layer of the putter head of this invention with dimples in the putter head cavity and the face plate side.
FIG. 13 is a horizontal cross section view of an alternative elastic layer of the putter head of this invention with right angles.
FIG. 14 is a horizontal cross section view of an alternative elastic layer of sidewall the putter head of this invention with curved angles.
FIG. 15 is a horizontal coss section view of an alternative elastic layer sidewall of the putter head of this invention with angles.
FIG. 16 is a horizontal cross section view of an alternative elastic layer sidewall of the putter head of this invention with multiple angles.

Referring to FIG. 12, a cross section view of an alternative side interface of face plate side wall 227, side wall of putter head cavity 224 has dimple 226 and side wall of face plate 227 has dimple 228 with elastic layer 222.

Referring to FIG. 13, a cross section view of an alternative right angle side interface of face plate side wall 234, side wall of putter head cavity 232 and elastic layer 236 of putter head 230 of this invention is shown. This alternative design minimizes rotation on face plate 234 with off center ball contact.

Referring to FIG. 14, a cross section view of an alternative side interface using rounded angles of face plate side wall 244, side wall of putter head cavity 242 and elastic layer 246 of putter head 240 of this invention is shown.

Referring to FIG. 15, a cross section view of an alternative side interface using decreased angles of face plate side wall 254, side wall of putter head cavity 252 and elastic layer 256 and elastic layer 253 of different durometer of putter head 240 of this invention is shown.

Referring to FIG. 16, a cross section view of an alternative side interface using several angles of face plate side wall 264, side wall of putter head cavity 262 and elastic layer 266 of putter head 260 of this invention is shown. At the putter surface, face plate 265 and putter head 263 meet in close proximity and slide when compressed by contact.

Figure 17:
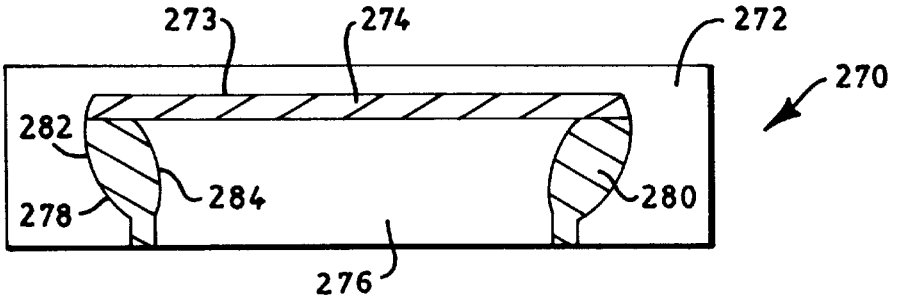
FIG. 17 is a horizontal cross section view of an alternative putter head of this invention with elliptical elastic layer sidewalls.

Referring to FIG. 17, a cross section view of an alternative putter head 272 of putter 270 of this invention is shown. Putter head 272 is joined to face plate 276 with elastic layer 274 and elastic layers 280 and 278 which are of an elliptical shape and similar or different durometer. The shape of this area is shown as elliptical but is not limited to this shape. Alternative shapes include square, round, triangular, rectangular, polygonal, combination of these or the like. Side wall 284 of face plate 276 is concave which results in an increased amount of elastic material 278 for better control of forces. Face plate rotation is better controlled with use of adhesives which join face plate 276 to elastic layers 274, 278 and 280 to putter head cavity 273 of putter head 272.

However, mechanical retention through sandblasting, etching, holes, extensions or the like can be used. It is not necessary to use these added retention features on all areas but are alternatively used in selective area as required to control compression or stretch of the low durometer layer or layers. For example, alternatively adhesive is used on elastic layer 274 but not on elastic layers 278 and 280.

Figure 18:
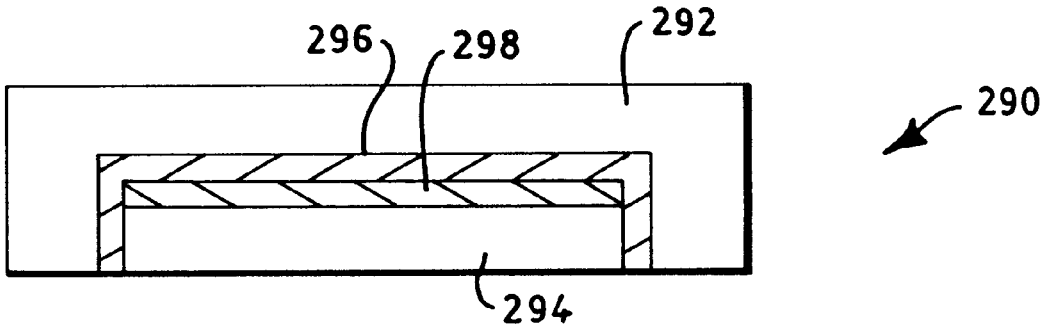
FIG. 18 is a horizontal cross-section view of an alternative putter head of this invention with two different elastic layers.

Referring to FIG. 18, a cross section view of an alternative putter head 292 of putter 290 of this invention is shown. Face plate 294 is joined to putter head 292 of putter 290 by elastic layers 298 and 296. Elastic layer 298 is between elastic layer 296 and face plate 294 and is of a differing, either increased or decreased, durometer than elastic layer 296. Different durometer of materials is accomplished by use of differing durometer of the same material or by use of different materials. The use of dual durometer layer controls the amount of compression of face plate 294 at different force of ball contact. As an example, when the durometer of elastic layer 298 is low and elastic layer 296 is higher, compresses elastic layer 298 to a minimum thickness followed by force applied to and compression of elastic layer 296. Face plate 294 compresses less and rebounds more quickly resulting in better ball control with minimum loss of distance of ball travel.

Figure 19:
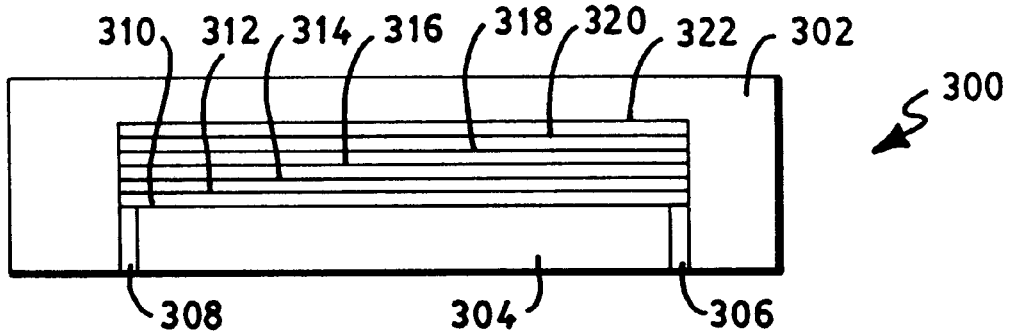
FIG. 19 is a horizontal cross-section view of an alternative putter head of this invention with multiple layered elastic layers.
Figure 26:
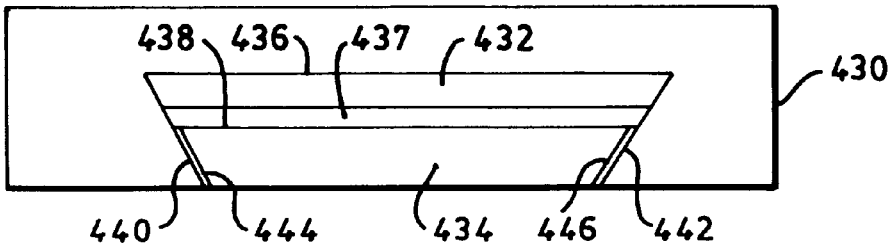
FIG. 26 is a horizontal cross section view of an alternative putter head of this invention where the face plate is compressed onto the front wall of a putter head cavity by an elastic layer.

Referring to FIG. 19, a cross section view of an alternative putter head 302 of putter 300 of this invention is shown. Face plate 304 has sides areas 306 and 308 which arc open or filled with elastic material. Side areas 306 and 308 can be one micron to one centimeter in width or can be eliminated by component taper allowing intimate contact as is seen in FIG. 26. Behind face plate 304 are increasing or decreasing durometer elastic layers 310, 312, 314, 316, 318 and 320 enclosed in putter head cavity 322 of putter head 302 of putter 300. That is elastic layer 310 can have the highest durometer while elastic layer 320 has the lowest durometer with the intermediate layers providing durometer gradient. Alternative layer 310 can have the lowest durometer and layer 320 can have the highest durometer. The use of different durometer elastic layers require compression of the lowest durometer materials prior to compression of the next highest durometer material which must be compressed before compression of the next highest durometer layer. The use of multiple layers or a gradient layer provides less compression and quicker rebounds of the elastic layers. This, in turn, provides better ball control with minimum loss of ball travel distance at all club head speeds during ball contact.

Figure 20:
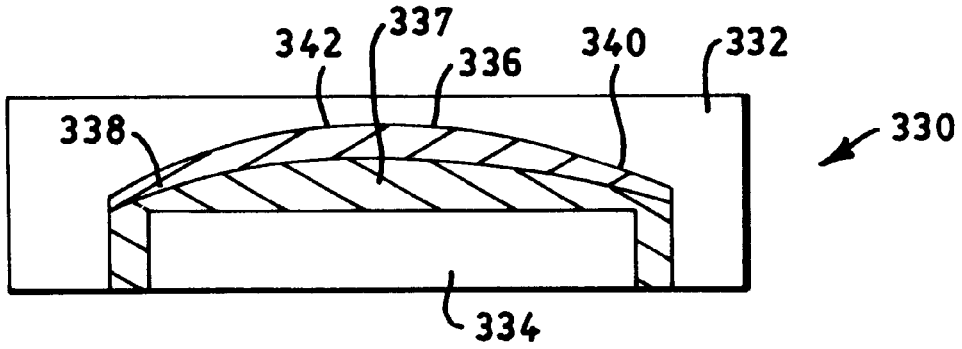
FIG. 20 is a horizontal cross-section view of an alternative putter head of this invention with back wall of the putter head cavity curved.

Referring to FIG. 20, a cross section view of an alternative putter head 332 of putter 330 of this invention is shown. Face plate 334 joined to putter head cavity 342 of putter head 332 of putter 330 by elastic layer 337 of higher or lower durometer than layer 336. Back wall of putter head cavity 342 is curved so elastic layer 336 has an increased thickness toward the center of putter 330. When face plate 334 is constructed of a material which is flexible elastic layer 336 allows increased flexure in the center and decreased flexure on lateral areas as lateral elastic layer 338 and 340 compressed less. This results in an even distribution of force and feel over a wider area and, therefore, an increased sweet spot.

Figure 21:
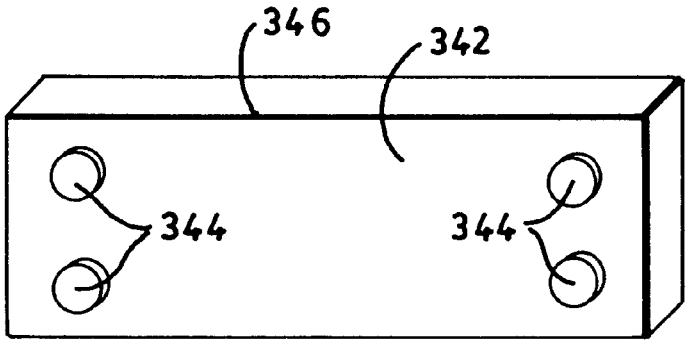
FIG. 21 is a view of a back surface of an alternative face plate and elastic tabs of this invention.
Figure 22:
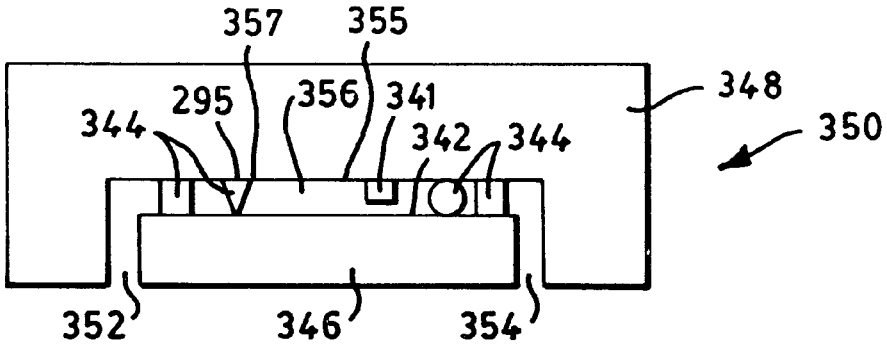
FIG. 22 is a cross section view of the face plate and elastic tabs of FIG. 21 in a putter head.

Referring to FIGS. 21 and 22, an alternative elastic configuration using elastic tabs 344 is positioned against back wall 342 of face plate 346 and rear wall 357 of putter head cavity 355 of putter head 348 of putter 350. Elastic tabs 344 have any shape such as round, spherical, oval, hollow, meshed, square, rectangular, polygonal, two or three dimensionally triangular or the like and are used in any number from one to hundreds. Face plate 346, elastic tabs 344, and putter cavity 355 create open spaces 356, 352 and 354. Open spaces 356, 352 and 354 are alternatively left open or filled with elastic materials of similar or differing durometer. Elastic tabs 344 can be constructed of two or more layers of elastic materials or can be of different durometer one to the other. Elastic tab 344 shapes can provide gradient compression by shape design. For example, a triangular shape with an apex against the face plate would have minimum elastic material resisting initial compression. As compression continues, elastic material is provided to resist compression as the cross section area of elastic material increases in the direction of the triangle base 345. Elastic tab 341 reveals a tab which is attached to the backwall 357 of putter head cavity 355 but does not touch back wall 342 of face plate 346. The resulting space means that face plate 346 does not engage tab 341 until compression on tab 344 has occurred.

Figure 23:
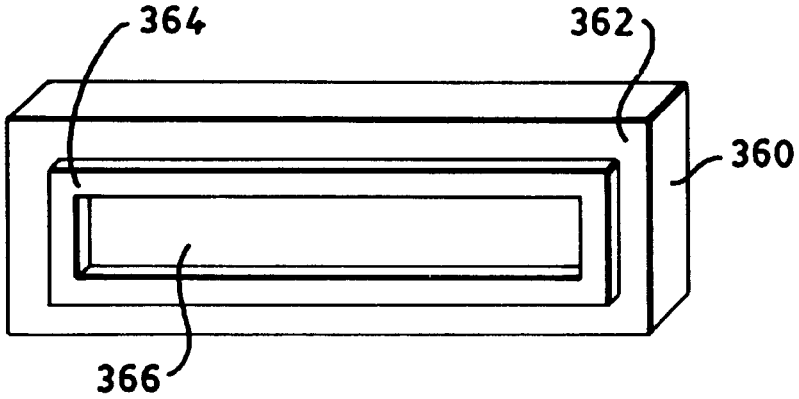
FIG. 23 is a view of a back surface of an alternative face plate and elastic layer of this invention.

Referring to FIG. 23, a rear view of an alternative elastic rectangle 364 positioned on rear wall 362 of putter face plate 360 is shown. Elastic rectangle 364 alternatively is attached with adhesive to a putter face plate and putter cavity to create a sealed open area 366. Sealed open area 366 creates a pocket of air which does not escape so when pressure is applied to a face plate it is resisted by the trapped air. Advanced alternatives create a pressured cushion of air by surrounding the air completely with an elastic layer a balloon effect. Elastic layer 364 alternatively is used in combination with elastic tabs or elastic layers of the same or differing durometers with a single component such as elastic tabs having different durometer layers or an elastic rectangle having different sides of different durometer.

Figure 24:
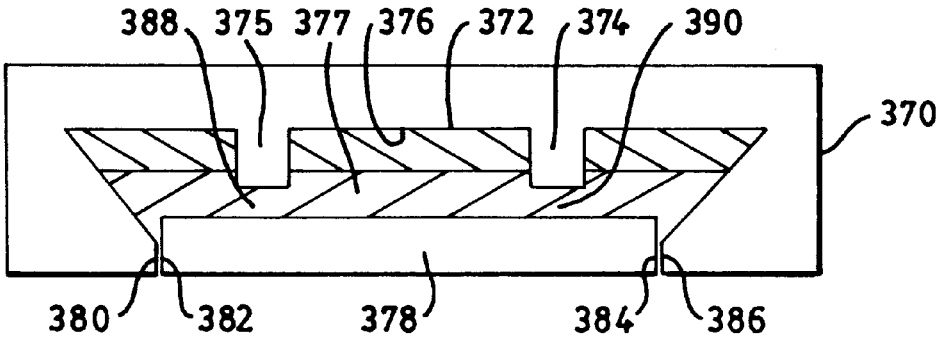
FIG. 24 is a horizontal cross section view of an alternative putter head of this invention with back wall of the putter head cavity having projections.

Referring to FIG. 24, a cross section view of an alternative putter head cavity 372 having extensions 374 and 375 attached of putter head 370, having face plate 378 joined to the putter head by elastic layer 376 and elastic layer 377 of different durometer. Extensions 374 and 375 of putter head cavity 372 result in thinner areas of elastic material 388 and 390 between them and face plate 378. Face plate 378 has lateral walls 382 and 384 which contact lateral walls 380 and 386 of putter cavity 372 so movement is limited to straight back and forward as lateral tilt will cause wall to wall engagement.

Figure 25:
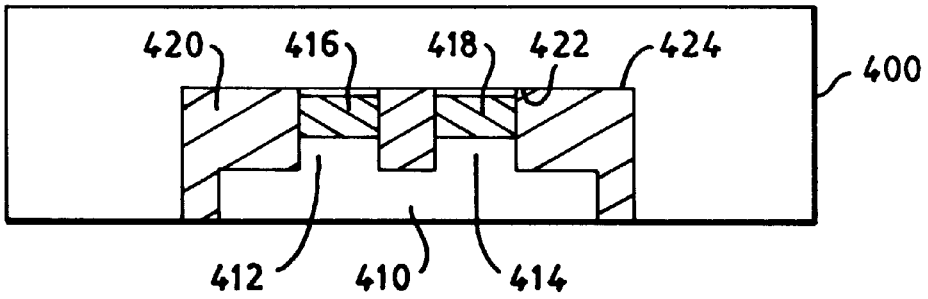
FIG. 25 is a horizontal cross section view of an alternative putter head of this invention with back wall of the face plate having extensions.

Referring to FIG. 25, a cross section view of an alternative putter head cavity 424 of putter head 400 and face plate 410 having extensions 412 and 414 joined to the putter head 400 by elastic layer 420. Extensions 412 and 414 of face plate 410 result in thinner areas of elastic material 416 and 418 between them and back wall 422 of putter cavity 424 of putter head 400. Thinner elastic areas 416 and 418 are of the same or different durometer material as surrounding elastic area 420 and control amount of compression by measuring extension 412 and 414 surface area to elastic layer 416 and 418 durometer and thickness.

Referring to FIG. 26, a cross section view of an alternative putter head cavity 436 of putter head 430 and face plate 434 is seen. Face plate 434 has lateral walls 444 and 446 which are tapered in an increasing diameter from front to back. Tapered walls 440 and 442 of putter cavity 436 of putter head 430 match degree of taper of lateral walls 444 and 446 such that intimate contact occurs with pressure of elastic layer 432 and elastic layer 437 of different durometer against back wall 438 of face plate 434. Elastic layers 432 and 437 can apply constant pressure or be static with no pressure.

The club head of this invention allows for controlled compression of a face plate at any club head speed. Compression is controlled by limiting thickness of an elastic layer depending on the elasticity of the material. Utilizing different durometer materials allows control of sweet spot area and further control of face plate compression.

Utilizing a hard or high durometer at the surface of the putter head to face plate interface means that no low durometer material at the surface can accidently strike the ball. There is no face plate or putter cavity edges which can misdirect a ball strike. Alternatively, a space can be left at the putter face plate to putter cavity interface or intimate contact is made.

I claim:

1. A head construction for a golf putter club which comprises;

a putter head having a cavity extending from a surface for contacting a golf ball into said putter head, said cavity having a back surface remote from said surface for contacting a golf ball, an exposed face plate positioned within said cavity, said face plate having a hardness at least as hard as a golf ball, a flexible layer positioned within said cavity wherein said flexible layer is formed of discrete compressible pieces having a differing cross section through its thickness said flexible layer being in contact with said face plate, and said flexible layer having a hardness which is softer than said face plate, and said face plate being movable with said cavity.

2. The golf head construction of claim I wherein said flexible layer is formed of at least two layers having differing hardness.

3. The golf head construction of claim 2 wherein said flexible layer is formed of two layers.

4. The golf club of any one of claims 1, 2 or 3 wherein said face plate has a Shore A hardness of at least about 100.

5. The golf club of any one of claims 1, 2 or 3 wherein said face plate is exposed on a top surface of said putter head.

6. The golf club of any one of claims 1, 2 or 3 wherein said face plate is exposed on a bottom surface of said putter head.

7. The golf club of claim 5 wherein said face plate has a Shore A hardness of at least about 100.

8. The golf club of claim 6 wherein said face plate has a Shore A hardness of at least about 100.

9. The golf head of claim 1 wherein said flexible layer has a hardness gradient through its thickness.

10. The golf club of claim 1 wherein said discrete pieces are positioned within a composition having a Shore A durometer hardness less than about 40.

11. The golf head of claim 1 wherein said discrete compressible pieces have a triangular cross section.

* * * * *